US008864535B2

(12) United States Patent
Gingrich, III

(10) Patent No.: US 8,864,535 B2
(45) Date of Patent: Oct. 21, 2014

(54) POKE-IN CONTACT WITH MULTIPLE CONTACT SECTIONS TO ACCEPT AND TERMINATE A RESPECTIVE WIRE FROM VARIED DIRECTIONS

(75) Inventor: Charles R. Gingrich, III, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 51 days.

(21) Appl. No.: 13/584,357

(22) Filed: Aug. 13, 2012

(65) Prior Publication Data

US 2014/0045391 A1 Feb. 13, 2014

(51) Int. Cl.
*H01R 4/48* (2006.01)

(52) U.S. Cl.
USPC ..... 439/862

(58) Field of Classification Search
USPC ..... 439/404, 417, 853–862
See application file for complete search history.

(56) References Cited

U.S. PATENT DOCUMENTS

| | | | | |
|---|---|---|---|---|
| 4,346,955 | A * | 8/1982 | Chesnais et al. | 439/407 |
| 4,391,484 | A * | 7/1983 | Foederer | 439/404 |
| 4,448,473 | A * | 5/1984 | Felix et al. | 439/409 |
| 4,576,429 | A * | 3/1986 | Hardouin et al. | 439/441 |
| 4,865,563 | A | 9/1989 | Ney et al. | |
| 5,713,767 | A * | 2/1998 | Hanson et al. | 439/853 |
| 5,890,924 | A * | 4/1999 | Endo et al. | 439/417 |
| 6,080,008 | A * | 6/2000 | Frantz | 439/441 |
| 7,134,920 | B1 * | 11/2006 | Ju et al. | 439/691 |
| 7,285,006 | B1 * | 10/2007 | Daily et al. | 439/441 |
| 7,309,252 | B2 * | 12/2007 | Fabian et al. | 439/404 |
| 2004/0253974 | A1 * | 12/2004 | Kao et al. | 455/550.1 |
| 2006/0228947 | A1 | 10/2006 | Landis et al. | |
| 2007/0111612 | A1 | 5/2007 | Fabian et al. | |

FOREIGN PATENT DOCUMENTS

| | | | |
|---|---|---|---|
| DE | 1240573 | B | 5/1967 |
| DE | 12 46 078 | B | 8/1967 |
| DE | 93 08 098 | U1 | 10/1993 |
| EP | 1 865 577 | A2 | 12/2007 |
| ES | 2 347 514 | A1 | 10/2010 |

OTHER PUBLICATIONS

International Search Report, International Application No. PCT/US2013/053333, International Filing Date, Aug. 2, 2013.

* cited by examiner

*Primary Examiner* — Chandrika Prasad

(57) ABSTRACT

An electrical contact to be housed in a connector includes a mating member receiving section and a wire receiving section. The mating member receiving section is configured to mate with a mating member to provide an electrical connection there between. The wire receiving section has multiple contact sections, with each contact section configured for receiving one respective wire therein. Each contact section is oriented to receive the one respective wire from a different direction. The wire receiving section permitting insertion of only one respective wire in the wire receiving section at one time. The varied orientation of the contact sections of the wire receiving section allows the one respective wire to be inserted into the contact from different directions, providing an electrical connection between the one respective wire and the contact.

16 Claims, 6 Drawing Sheets

POKE-IN CONTACT WITH MULTIPLE CONTACT SECTIONS TO ACCEPT AND TERMINATE A RESPECTIVE WIRE FROM VARIED DIRECTIONS

FIELD OF THE INVENTION

This invention relates generally to a wire contact, and, more particularly, to poke-in wire contact which has multiple contact sections to allow respective wires to be inserted into the contact in multiple directions.

BACKGROUND OF THE INVENTION

The electrical grid connecting America's power plants, transmission lines and substations to homes, businesses and factories operate almost entirely within the realm of high voltage alternating current (AC). Yet, an increasing fraction of devices found in those buildings actually operate on low voltage direct current (DC). Those devices include, but are not limited to, digital displays, remote controls, touch-sensitive controls, transmitters, receivers, timers, light emitting diodes (LEDs), audio amplifiers, microprocessors, other digital electronics and virtually all products utilizing rechargeable or disposable batteries.

Installation of devices utilizing low voltage DC has been typically limited to locations in which a pair of wires is routed from the voltage source. Increased versatility in placement and powering of low voltage DC products is desirable. Specifically, there is an increasing desire to have electrical functionality, such as power and signal transmission, in the interior building environment, and specifically in the ceiling environment, without the drawbacks of existing systems.

Commercial building spaces such as offices, laboratories, light manufacturing facilities, health facilities, meeting and banquet hall facilities, educational facilities, common areas in hotels, apartments, retirement homes, retail stores, restaurants and the like are commonly constructed with suspended ceilings. These suspended ceiling installations are ubiquitous, owing to their many recognized benefits. Such ceilings ordinarily comprise a rectangular open grid suspended by wire from a superstructure and tile or panels carried by the grid and enclosing the open spaces between the grid elements.

Many relatively low power devices are now supported on such ceilings and newer electronic devices and appliances are continuously being developed and adopted for mounting on ceilings. The ceiling structure, of course, typically overlies the entire floor space of an occupiable area. This allows the ceiling to support electronic devices where they are needed in the occupied space. Buildings are becoming more intelligent in energy management of space conditioning, lighting, noise control, security, and other applications. The appliances that provide these features including sensors, actuators, transducers, speakers, cameras, recorders, in general, all utilize low voltage DC power.

In an effort to provide greater efficiency and ease of use, internal bus bars have been positioned in the ceiling grid. One such system is described in the documents related to the Emerge Alliance. Such systems provide electrical power through two parallel bus bars embedded with the support rails of a suspended ceiling. Electrical connectors are mated with the bus bars to supply power to various low voltage devices. However, these connectors are often difficult to install, difficult to terminate to the various devices, and/or they are expensive and complicated to manufacture and assembly.

What is needed are contacts and connectors which can be easily terminated to respective devices and which reduces the cost and complexity of manufacture of the contacts and connectors. The present invention accomplishes these need and provides additional advantages, such as but not limited to, providing a poke-in type contact which can be used in conjunction with the grid framework or in any other applications in which poke-in type contacts may be utilized.

SUMMARY OF THE INVENTION

According to an exemplary embodiment an electrical contact to be housed in a connector includes a mating member receiving section and a wire receiving section. The mating member receiving section is configured to mate with a mating member to provide an electrical connection there between. The wire receiving section has multiple contact sections, with each contact section configured for receiving one respective wire therein. Each contact section is oriented to receive the one respective wire from a different direction. The wire receiving section permitting insertion of only one respective wire in the wire receiving section at one time. The varied orientation of the contact sections of the wire receiving section allows the one respective wire to be inserted into the contact from different directions, providing an electrical connection between the one respective wire and the contact.

According to an exemplary embodiment a poke-in contact to be housed in a connector includes a mating member receiving section, a mounting section and a wire receiving section. The mating member receiving section is configured to mate with a mating member to provide an electrical connection there between. The mounting section cooperates with the connector to maintain the contact in the connector. The wire receiving section has multiple contact sections, with each contact section configured for receiving one respective wire therein. Each contact section is oriented to receive the one respective wire from a different direction. The wire receiving section permitting insertion of only one respective wire in the wire receiving section at one time. The varied orientation of the contact sections of the wire receiving section allows the one respective wire to be inserted into the contact from different directions, providing an electrical connection between the one respective wire and the contact.

According to an exemplary embodiment a poke-in contact for receiving one respective wire includes a wire receiving section. The wire receiving section has: a first contact section into which the one respective wire may be inserted from a first direction and terminated; a second contact section into which the one respective wire may be inserted from a second direction and terminated; and a third contact section into which the one respective wire may be inserted from a third direction and terminated. The varied orientation of the contact sections of the wire receiving section allows the one respective wire to be inserted into the contact from different directions, providing an electrical connection between the respective wire and the contact.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
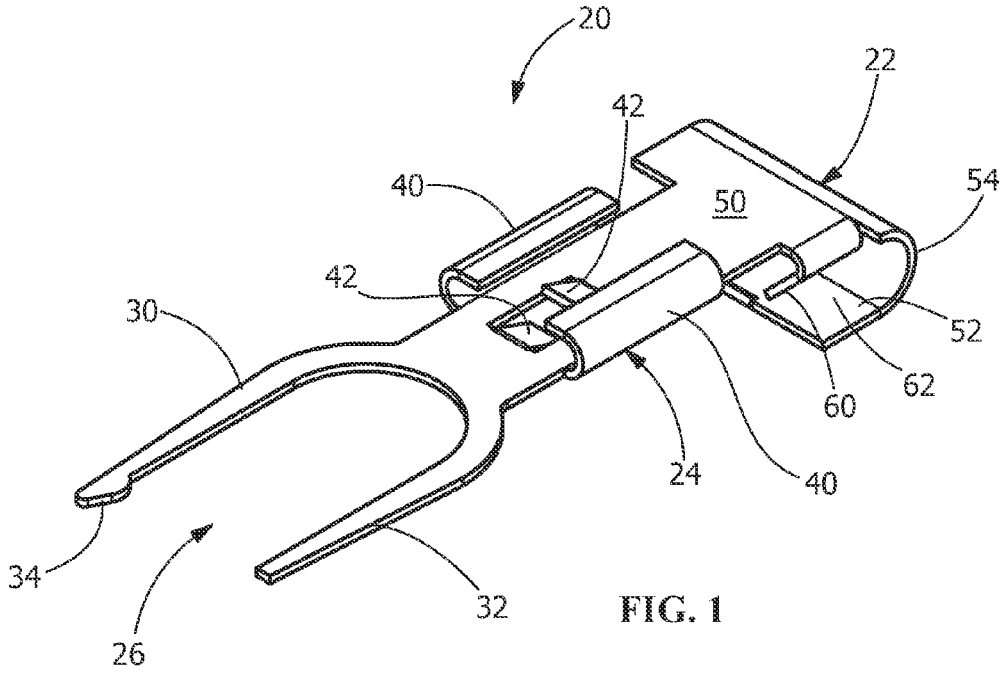
FIG. 1 is a front perspective view of an exemplary embodiment of a contact of the present invention.

The present invention will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are illustrative and are provided so that this disclosure will be thorough and complete, and will fully convey the scope of the invention to those skilled in the art.

It will be understood that spatially relative terms, such as "top", "upper", "lower" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "over" other elements or features would then be oriented "under" the other elements or features. Thus, the exemplary term "over" can encompass both an orientation of over and under. The device may be otherwise oriented (rotated 90 degrees or at other orientations) and the spatially relative descriptors used herein interpreted accordingly.

Figure 2:
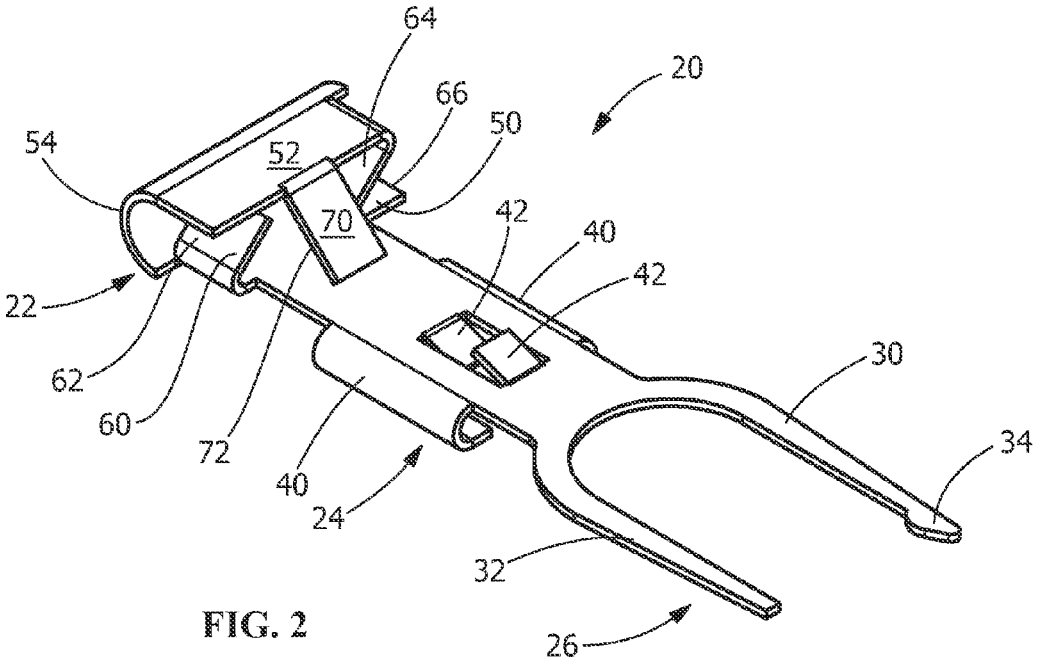
FIG. 2 is a bottom perspective view of the exemplary embodiment of the contact shown in FIG. 1.
Figure 3:
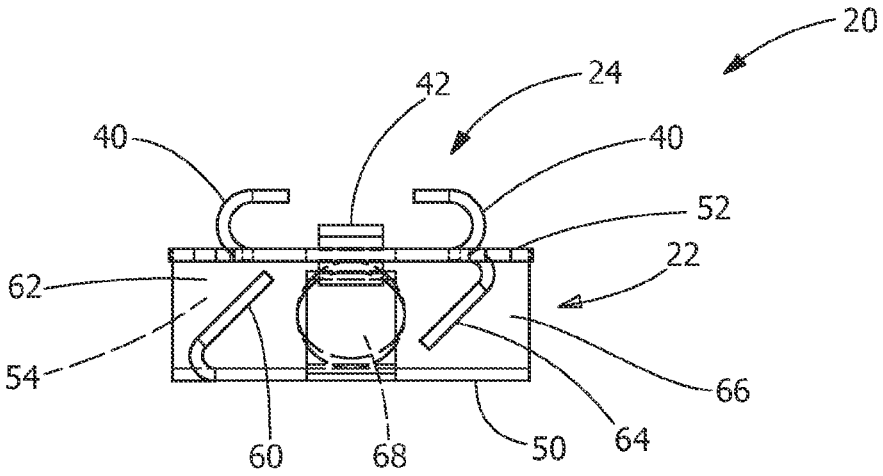
FIG. 3 is a top view of the exemplary embodiment of the contact shown in FIG. 1, with the top surface shown in phantom to expose the deflectable contact beams positioned below the top surface.

Referring to FIGS. 1 through 3, an exemplary contact 20 is illustrated. The contact 20 has a wire receiving section 22, a mounting section 24 and a mating member receiving section 26. The contact is fabricated from a conductive material. In the exemplary embodiment shown, the wire receiving section 22, the mounting section 24 and the mating member receiving section 26 form an essentially planar contact which is inserted into a connector housing, as will be more fully described.

The mating member receiving section 26 is configured to mate with a mating member to provide an electrical connection there between. In the exemplary embodiment illustrated, the mating member receiving section 26 has two opposed legs 30, 32 which form a U-shaped member. The U-shaped member is configured to be placed in electrical engagement with a mating member or rail of an electrified grid of the type shown in co-pending U.S. application Ser. No. 13/309,600 filed Dec. 2, 2011, which is incorporated in its entirety herein by reference. A projection 34 extends from proximate the end of leg 30. The projection 34 acts as the contact point which electrically connects the terminal 20 to the mating member. While the exemplary mating member receiving section 26 is shown with two legs, other configurations are possible without departing from the scope of the invention.

In the exemplary embodiment illustrated, the mounting section 24 is positioned between the mating member receiving section 26 and the wire receiving section 22. The mounting section 24 cooperates with a connector housing to maintain the contact in the connector. The mounting section 24 has rounded sections 40 which extend from opposed sides of the mounting section 24. The rounded sections 40 engage walls or other structural members of the connector housing to maintain the mounting section 24 and the contact 20 in position, preventing the unwanted movement of the contact 20 in a direction which is transverse to the longitudinal axis of the contact 20. Additionally, the mounting section 24 has one or more barbs 42 which extend from the mounting section 24 in a direction outside the plane of the mounting section 24. The barbs 42 cooperate with the connector housing to maintain the mounting section 24 and the contact 20 in position, and to prevent the unwanted movement of the contact 20 in a direction which is parallel to the longitudinal axis of the contact 20. The combination of the rounded sections 40 and the barbs 42 adequately secure the contact 20 in the connector housing, thereby preventing the unwanted movement or removal of the contact 20. While the exemplary mounting section 24 is shown with sections 40 and barbs 42, other configurations are possible without departing from the scope of the invention.

In the exemplary embodiment illustrated, the wire receiving section 22 has a first side wall 50, a second side wall 52 and a top wall 54 which extends between the first side wall 50 and the second side wall 52. The first side wall 50 extends from proximate the mounting section 24 in a direction away from the mating member receiving section 26. The first side wall 50 is essentially planar to the mounting section 24. The top wall 54 has an arcuate configuration and extends from the first side wall 50 to the second side wall 52. The second side wall 52 is spaced from the first side wall 50 and extends essentially parallel to the first side wall 50.

As best viewed in FIGS. 2 and 3, an end portion of the first side wall 50 is bent inward toward the second side wall 52 to form a first deflectable contact beam 60. The first deflectable contact beam 60 and the portion of the second side wall 52 which is positioned proximate thereto form a first contact section 62 into which a respective wire may be inserted from a first direction and be terminated, as will be more fully described.

An end portion of the second side wall 52 is bent inward toward the first side wall 50 to form a second deflectable contact beam 64. The second deflectable contact beam 64 and the portion of the first side wall 50 which is positioned proximate thereto form a second contact section 66 into which a respective wire may be inserted from a second direction and be terminated, as will be more fully described.

An opening 68 (FIGS. 3 and 4) is provided in the top wall 54. The opening 68 is positioned between the first contact section 62 and the second contact section 66, with the opening configured to allow insertion of a respective wire there through. A portion of the second side wall 52, which extends away from the top wall 54, is bent inward toward the first side wall 50 to form a third deflectable contact beam 70, as best shown in FIG. 2. The third contact beam 70 is formed such that the third contact beam 70 is positioned in vertical (as viewed in the drawings) alignment with the opening 68. The third contact beam 70 and the portion of the first side wall 50 which is positioned proximate thereto form a third contact section 72 into which a respective wire may be inserted in a third direction through the opening 68 and be terminated therein, as will be more fully described.

The wire receiving section 22 has multiple contact sections 62, 66, 72, with each contact section 62, 66, 72 configured for receiving a respective wire therein, and with each contact section 62, 66, 72 oriented to receive the respective wire from a different direction. In the exemplary embodiment shown, the configuration of the contact 20 with three contact sections 62, 66, 72 allows for a wire to be terminated or poked-in to the contact 20 from the left side (as viewed in FIG. 1), the right side (as viewed in FIG. 1) or the top (as viewed in FIG. 1) of the contact 20. This allows for maximum flexibility for the design of the connector housing and for the end use of the connector. In other words: a wire can be poked-in from the left side to engage the first contact section 62; a wire can be poked-in from the right side to engage the second contact section 66; or a wire can be poked-in from the top side to engage the third contact section 72.

Figure 4:
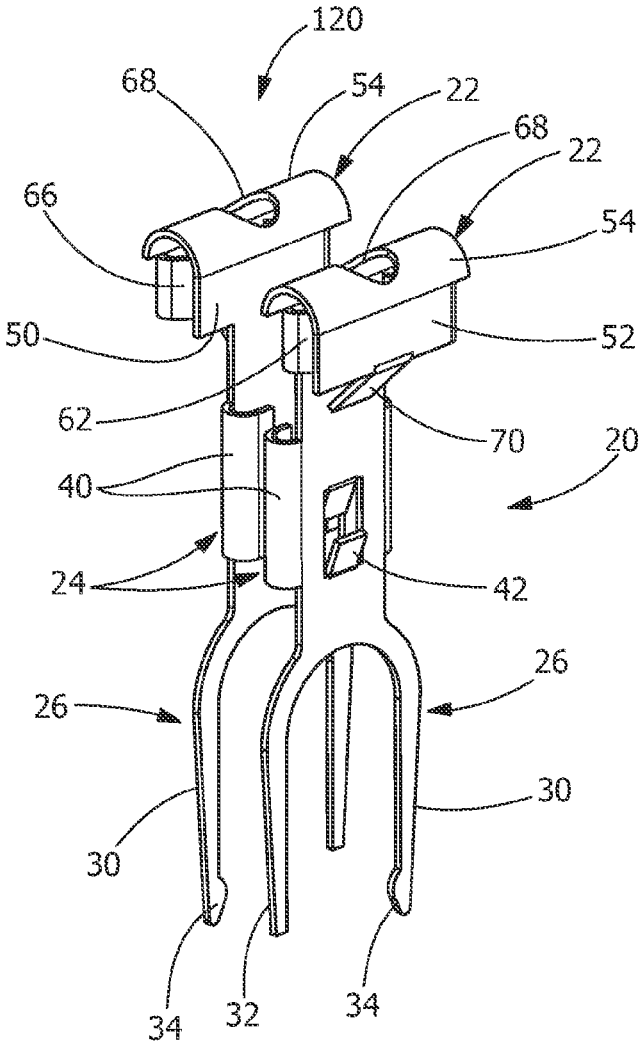
FIG. 4 is a perspective view of two of the contacts of FIG. 1 positioned next to each other, with one of the respective contacts rotated 180 degrees relative to the other contact.
Figure 5:
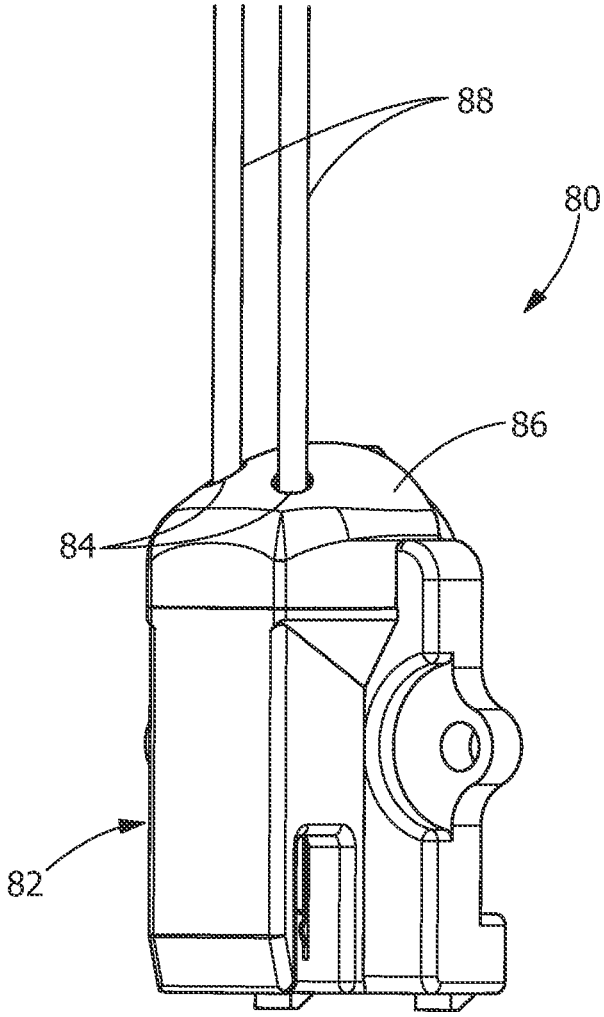
FIG. 5 is a perspective view of an exemplary connector which houses contacts positioned therein; wires are shown inserted through a top surface of the connector.

Referring now to FIG. 4, two contacts 20, 120 are provided proximate each other. Contact 120 is identical to contact 20, with the exception the contact 120 has been rotated 180 degrees. This allows for two wires from a device, such as, but not limited to, a lighting fixture to be terminated, with one wire (either positive or negative) being terminated to contact 20 and the other wire (either positive or negative) being terminated to the other contact 120. As an example, if the wires were to be poked-in from the left side, one wire would engage the first contact section 62 of contact 20 and the other wire would engage the second contact section 66 of contact 120. As another example, if the wires were to be poked-in from the right side, one wire would engage the second contact section 66 of contact 20 and the other wire would engage the first contact section 62 of contact 120. As another example, if the wires were to be poked-in from the top side, one wire would engage the third contact section 72 of contact 20 and the other wire would engage the third contact section 72 of contact 120.

Referring to FIGS. 5 through 8, two exemplary embodiments of connectors 80, 90 which house the contacts 20, 120 are shown. Connector 80 (FIGS. 5 and 6) has a connector housing 82 which has openings 84 which extend from a top surface 86 of the housing 82 to the contacts 20, 120. This allows respective wires 88 to be inserted from the top of the connector housing 82 into the third contact section 72 of the contacts 20, 120. Alternatively, connector 90 (FIGS. 7 and 8) has a connector housing 92 which has openings 94 which extend from a side surface 96 of the housing 92 to the contacts 20, 120. This allows respective wires 98 to be inserted from the side of the connector housing 92 into respective first or second contact sections 62, 66 of the contacts 20, 120.

Figure 6:
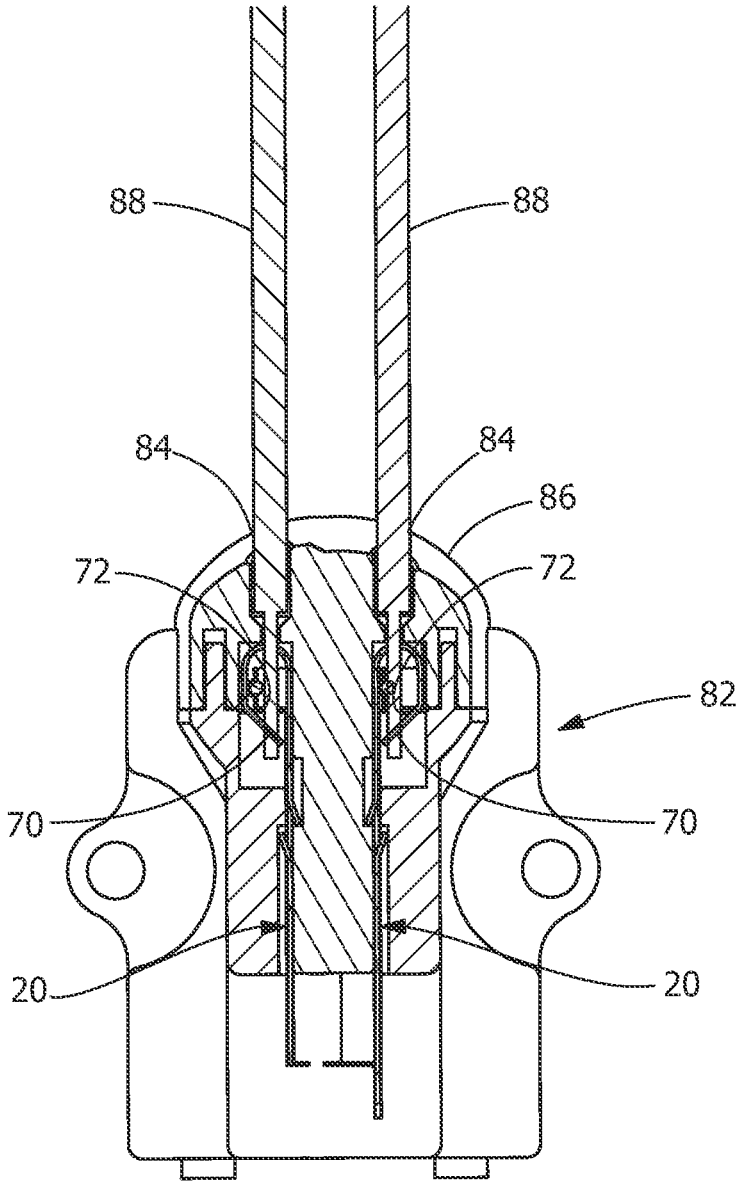
FIG. 6 is a cross-sectional view of the exemplary connector of FIG. 5, with the contacts shown in electrical engagement with respective wires.
Figure 7:
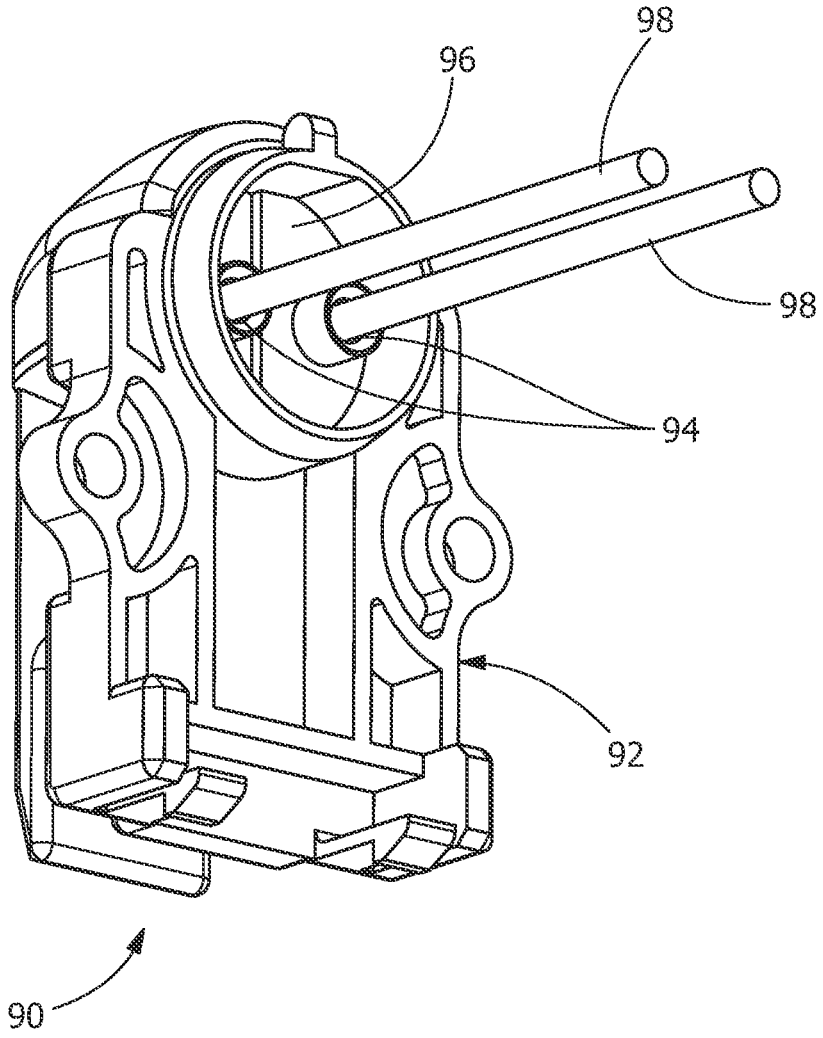
FIG. 7 is a perspective view of an exemplary connector which houses contacts positioned therein; wires are shown inserted through a side surface of the connector.

Referring to FIG. 6, when a respective wire 88 is inserted into the third contact section 72, the wire 88 is inserted through opening 68 (FIG. 3). The insertion of the wire 88 continues as the end of the wire 88 engages the third deflectable beam 70 which extends obliquely from the second side wall 52 toward the first side wall 50. Continued insertion of the wire 88 causes the third deflectable beam 70 to deflect in the direction away from the first side wall 50, to a loading position indicated in phantom in FIG. 6. When the wire 88 is sufficiently inserted, the third deflectable beam 70 returns toward its original position, thereby providing a spring force which clamps the wire 88 between the third deflectable beam 70 and the first side wall 50.

Figure 8:
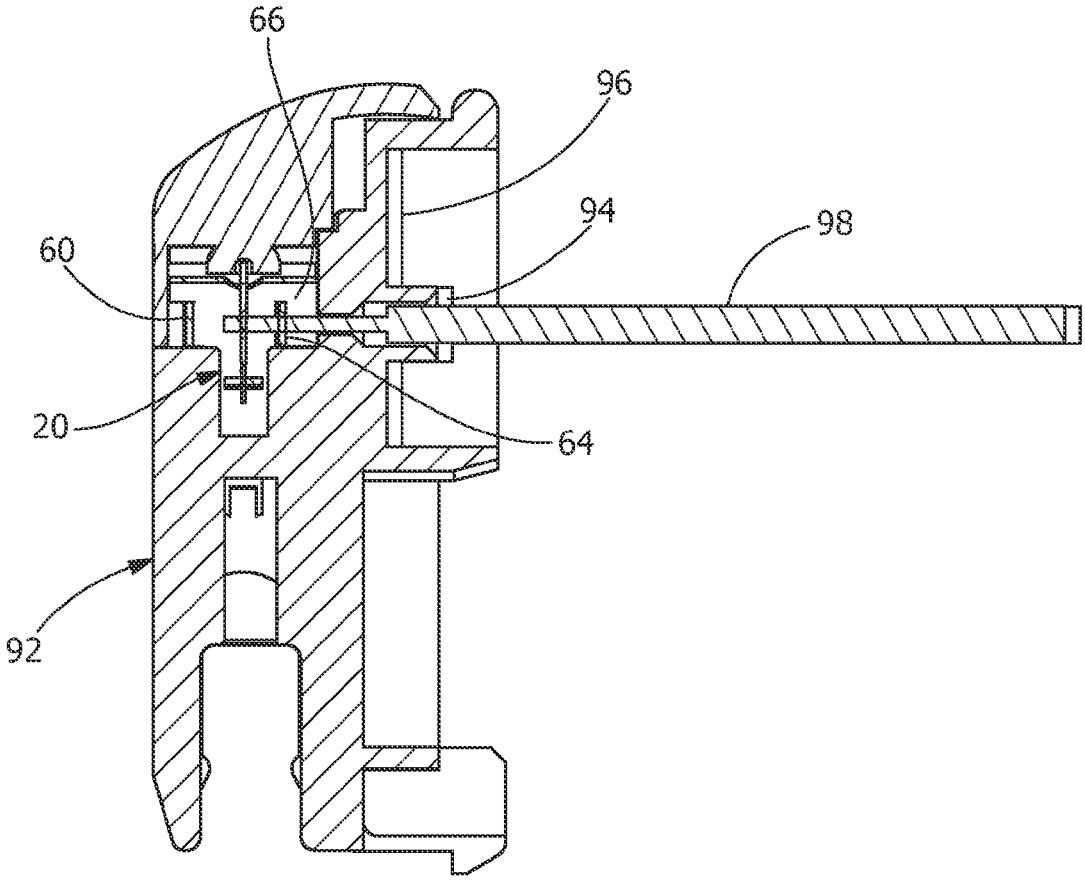
FIG. 8 is a cross-sectional view of the exemplary connector of FIG. 7, with a respective contact shown in electrical engagement with a respective wire.

Referring to FIG. 8, when a respective wire 98 is inserted into the first contact section 62, the insertion of the wire 98 continues as the end of the wire 98 engages the first deflectable beam 60 which extends obliquely from the first side wall 50 toward the second side wall 52. Continued insertion of the wire 98 causes the first deflectable beam 60 to deflect in the direction away from the second side wall 52, to a loading position indicated in phantom in FIG. 8. When the wire 98 is sufficiently inserted, the first deflectable beam 60 returns toward its original position, thereby providing a spring force which clamps the wire 98 between the first deflectable beam 60 and the second side wall 52. In this configuration, the second deflectable beam 64 may be used as a stop to prevent the over-insertion of the wire 98 into the first contact section 62. For example, as the wire 98 is inserted into the first contact section 62, the continued insertion of the wire 98 is inhibited as the end of the wire 98 engages the second deflectable beam 64 which does not deflect or which minimally deflects until the second deflectable beam 64 engages the second side wall 52, providing a wire stop feature when engaged from that direction.

Although not shown in FIG. 8, when a respective wire 98 is inserted into the second contact section 66, the insertion of the wire 98 continues as the end of the wire 98 engages the second deflectable beam 64 which extends obliquely from the second side wall 52 toward the first side wall 50. Continued insertion of the wire 98 causes the second deflectable beam 64 to deflect away from the first side wall 50, to a loading position. When the wire 98 is sufficiently inserted, the second deflectable beam 64 returns toward its original position, thereby providing a spring force which clamps the wire 98 between the second deflectable beam 64 and the first side wall 50. In this configuration, the first deflectable beam 60 may be used as a stop to prevent the over-insertion of the wire 98 into the second contact section 66. For example, as the wire 98 is inserted into the second contact section 66, the continued insertion of the wire 98 is inhibited as the end of the wire 98 engages the first deflectable beam 60 which does not deflect or which minimally deflects until the first deflectable beam 60 engages the first side wall 50, providing a wire stop feature when engaged from that direction.

While the connectors 80 and 90 are illustrated as two different connectors, a single connector housing may be provided with openings extending through a top surface and a side surface. However, in such a connector, wires can only be inserted through either the top surface or the side surface. Wires cannot be inserted through both the top and the side surfaces to create a daisy chain type of connection.

Regardless of the configuration of the housing, each contact 20, 120 is configured to accept only one respective wire at any given time. Multiple wires cannot be inserted and terminated in the wire receiving section 22 of a respective contact 20, 120 at the same time.

Because of the configuration of the contact sections, respective wire may be reliably connected to the contacts with reduced installation time and cost. Further, due to the multiple contact sections provided on each contact, respective wires may be inserted or poked-in to the contact from multiple directions, i.e. in the embodiments shown from the right side, the left side or the top side. This allows the same contact configuration to be used with various connector housing designs and end uses, including, but not limited to, connectors for use with low voltage electrified grid. This provides flexibility in design and reduces manufacturing and inventory costs, as the same contact can be used for numerous different connectors and numerous different applications.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical poke-in contact to be housed in a connector, the poke-in contact comprising:

a mating member receiving section, the mating member receiving section configured to mate with a mating member to provide an electrical connection there between;

a wire receiving section, the wire receiving section having a first contact section and a second contact section, the first and second contact sections configured for receiving respective wires therein, the first and second contact sections are oriented to receive the respective wires from different directions, the first contact section having a first deflectable contact beam which extends obliquely from a first side wall, the second contact section having a second deflectable contact beam which extends obliquely from a second side wall, the first contact section being formed from the first deflectable contact beam and the second side wall, the second contact section being formed from the second deflectable contact beam and the first side wall;

wherein varied orientation of the first and second contact sections of the wire receiving section allows the respective wires to be inserted into the poke-in contact from different directions, allowing the poke-in contact to be used with various housing designs of the connector.

2. The electrical poke-in contact as recited in claim 1, wherein the wire receiving section has a top wall which extends between the first side wall and the second side wall.

3. The electrical poke-in contact as recited in claim 2, further comprising a mounting section, the mounting section cooperates with the connector to maintain the poke-in contact in the connector.

4. The electrical poke-in contact as recited in claim 3, wherein the first side wall extends from proximate the mounting section in a direction away from the mating member receiving section, the first side wall being essentially planar to the mounting section.

5. The electrical poke-in contact as recited in claim 2, wherein the top wall has an arcuate configuration and extends from the first side wall to the second side wall, the second side wall being spaced from the first side wall and extending essentially parallel to the first side wall.

6. The electrical poke-in contact as recited in claim 2, wherein an end portion of the first side wall is bent inward toward the second side wall to form the first deflectable contact beam.

7. The electrical poke-in contact as recited in claim 2, wherein an end portion of the second side wall is bent inward toward the first side wall to form the second deflectable contact beam.

8. The electrical poke-in contact as recited in claim 2, wherein a portion of the second side wall which extends away from the top wall is bent inward toward the first side wall to form a third deflectable contact beam, the third contact beam and a portion of the first side wall which is positioned proximate thereto form a third contact section into which a respective wire may be terminated.

9. The electrical poke-in contact as recited in claim 8, wherein an opening is provided in the top wall, the opening positioned between the first contact section and the second contact section and in alignment with the third contact beam, the opening configured to allow insertion of the wire through the top wall and into the third contact section.

10. The electrical poke-in contact as recited in claim 1, wherein the mating member receiving section has two opposed legs which form a U-shaped member.

11. The electrical poke-in contact as recited in claim 10, wherein a projection extends from proximate the end of a respective leg of the two opposed legs and cooperates with the mating member to provide an electrical connection with the mating member.

12. The electrical poke-in contact as recited in claim 8, wherein the third deflectable contact beam extends obliquely from the second side wall.

13. The electrical poke-in contact as recited in claim 3, wherein the mounting section has rounded sections which extend from opposed sides of the mounting section, the rounded sections engage structural members of a connector housing of the connector to maintain the mounting section and the contact is position relative to the connector, preventing the unwanted movement of the contact in a direction which is transverse to the longitudinal axis of the contact.

14. The electrical poke-in contact as recited in claim 12, wherein the mounting section has one or more barbs which extend from the mounting section in a direction outside a plane of the mounting section, the barbs cooperate with the connector housing to maintain the mounting section and the contact in position, and to prevent the unwanted movement of the contact in a direction which is parallel to a longitudinal axis of the contact.

15. A poke-in contact to be housed in a connector, the contact comprising:

a mating member receiving section, the mating member receiving section configured to mate with a mating member to provide an electrical connection there between;

a mounting section, the mounting section cooperates with the connector to maintain the contact in the connector;

a wire receiving section, the wire receiving section having a first contact section, a second contact section and a third contact section, the first, second and third contact sections configured for receiving wires therein, the first, second and third contact sections are oriented to receive the wires from a different direction, the first contact section having a first deflectable beam which extends obliquely from a first side wall, the second contact section having a second deflectable beam which extends obliquely from a second side wall, and the third contact section having a third deflectable beam which extends obliquely from the second side wall, the first contact section being formed from the first deflectable contact beam and the second side wall, the second contact section being formed from the second deflectable contact beam and the first side wall, the third contact section being formed from the third deflectable contact beam and the first side wall, the wire receiving section having a top wall which extends between the first side wall and the second side wall, the top wall having an arcuate configuration extending from the first side wall to the second side wall, the second side wall being spaced from the first side wall and extending essentially parallel to the first side wall;

wherein varied orientation of the contact sections of the wire receiving section allows the a respective wire to be inserted into the contact from different directions, providing an electrical connection between the respective wire and the contact.

16. A poke-in contact with a wire receiving section, the wire receiving section comprising:

a first contact section, the first contact section having a first deflectable contact beam which extends from a first side wall toward a second side wall;

a second contact section, the second contact section having a second deflectable contact beam which extends from a second side wall toward the first side wall;

a third contact section, the third contact section having a third deflectable contact beam which extends from the second side wall toward the first side wall, the third deflectable contact beam being aligned with an opening in a top wall which extends between the first side wall and the second side wall;

the first contact section being formed from the first deflectable contact beam and the second side wall, the second contact section being formed from the second deflectable contact beam and the first side wall, the third contact section being formed from the third deflectable contact beam and the first side wall;

wherein varied orientation of the contact sections of the wire receiving section allows a wire to be inserted into the contact from different directions, providing an electrical connection between the wire and the contact, allowing the contact to be used with various connector housing designs.

* * * * *